United States Patent [19]

Stocker

[11] 3,984,094

[45] Oct. 5, 1976

[54] SEPARATOR CARD RETRIEVER

[75] Inventor: Lester H. Stocker, Phillipsburg, N.J.

[73] Assignee: Bell & Howell Company, Phillipsburg, N.J.

[22] Filed: Nov. 12, 1975

[21] Appl. No.: 631,052

[52] U.S. Cl. ..... 271/64; 209/74 R

[51] Int. Cl.[2] ..... B65H 29/60

[58] Field of Search ..... 271/64, 173; 209/74 R

[56] References Cited

UNITED STATES PATENTS

| | | | |
|---|---|---|---|
| 1,866,812 | 7/1932 | Lammerich | 271/64 |
| 3,229,599 | 1/1966 | Lowe | 271/173 |
| 3,631,979 | 1/1972 | Frankiewicz et al. | 209/74 R |
| 3,817,374 | 6/1974 | Hill et al. | 209/74 R |

*Primary Examiner*—Robert W. Saifer

*Attorney, Agent, or Firm*—Griffin, Branigan and Butler

[57] ABSTRACT

An apparatus for diverting selected cards or sheets from a normal path to a new path includes a rotatable surface member having an axis of rotation located above the plane of the normal path. The rotatable surface member has a stationary position which is out of the plane of the normal path so that documents are usually allowed to travel along the normal path under the rotatable surface member. However, the rotatable surface member is of a size such that when it is rotated, a portion thereof extends into the plane of the normal path. A document is diverted by rotating the rotatable surface member through the path immediately in front of the leading edge of the document and back through the normal path under the document, carrying the document with it to the new path across the top of the rotatable surface member.

9 Claims, 5 Drawing Figures

SEPARATOR CARD RETRIEVER

BACKGROUND OF THE INVENTION

This invention relates broadly to the art of sheet feeding apparatus, and more particularly to sheet feeders including mechanisms for diverting particular sheets to various paths.

A number of sheet diverter systems are disclosed in the following U.S. Pat. Nos: 3,460,673 to Sanner; 3,472,506 to Rabinow et al.; 3,543,929 to Mattia et al.; 3,556,518 to Brockmueller et al.; 3,674,143 to Hunter et al.; 3,791,516 to Tramposch; 3,768,644 and 3,754,647 to di Frank et al.; 3,820,775 to Miller; and 3,724,657 to Katagiri.

Most of these diverter systems comprise diverter walls which are moved between several positions to guide leading edges of sheets into respective paths. The Rabinow et al. system is somewhat unusual in that it employs a gear-shaped diverter which catches the leading edges of sheets with teeth and rotates them to either the left or the right. Miller and Katagiri describe sheet diverters which employ moveable rollers and belts for guiding sheets along desired paths.

A difficulty with all of these systems is that they are relatively slow to react in fast conveying situations. In this respect, in many present-day sheet-feeding systems, it is desired to separate a card or sheet from a normal path while yet allowing subsequent sheets to be fed immediately thereafter along the normal path. For example, in preparing cancelled checks for mailing bank statements, separator cards are placed between the checks of different individuals. As these checks are processed by an envelope-inserter machine, the separator cards are sensed by the machine for dividing the checks into different stacks corresponding to the individuals. The checks and separator cards are fed at extremely high speeds, one immediately after the other. Because of the difficulties involved in retrieving the separator cards in such an environment, the separator cards are usually simply sent with the checks to the individual customers. Such a procedure is wasteful and expensive.

It is therefore an object of this invention to provide a sheet diverter or retriever which can divert sheets from a normal path to a secondary path under conditions of high speed feeding.

It is yet another object of this invention to provide a sheet diverter which is relatively uncomplicated in structure and inexpensive to manufacture.

It is still another object of this invention to provide a sheet diverter having a position which is normally out of the path of travel of sheets but which can be selectively energized to move into and out of the normal path to thereby divert selected sheets travelling therein to a secondary path without affecting subsequently fed sheets.

SUMMARY OF THE INVENTION

According to principles of this invention, a rotatable surface member is positioned over a sheet path so that it normally allows sheets to move along the sheet path under it. However, when the rotatable surface member is selectively rotated, a portion thereof extends into the sheet path. The invention includes a mechanism for selectively energizing the rotatable surface member through the sheet path in front of the leading edge of a sheet to be diverted and back through the path under the sheet, thereby lifting the sheet above the rotatable surface member. As the sheet is fed further over the rotatable surface member it travels along a secondary sheet path.

BRIEF DESCRIPTION OF THE DRAWINGS

The foregoing and other objects, features and advantages of the invention will be apparent from the following more particular description of a preferred embodiment of the invention, as illustrated in the accompanying drawings in which reference characters refer to the same parts throughout the different views. The drawings are not necessarily to scale, emphasis instead being placed upon illustrating principles of the invention in a clear manner.

DESCRIPTION OF A PREFERRED EMBODIMENT

Figure 1:
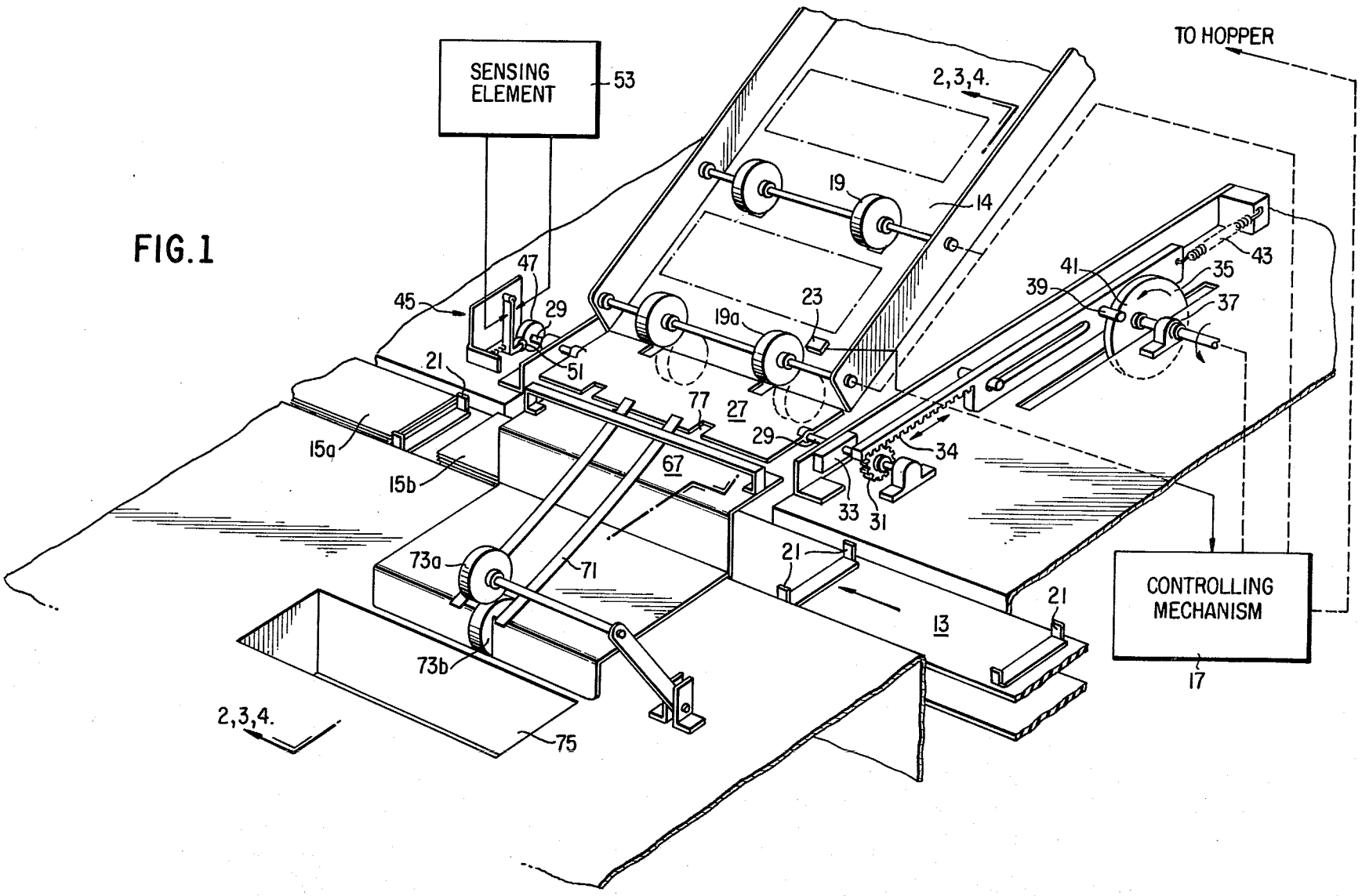
FIG. 1 is an isometric view of a portion of an inserting machine including a sheet diverter employing principles of this invention.

A portion of an inserting machine is depicted in FIG. 1 and elements thereof are depicted in greater detail in FIGS. 2–5. Basically, this mechanism feeds checks and separator cards from a hopper (not shown) to an insert conveyor 13 along a feed surface 14. The insert conveyor 13 carries stacks of checks 15*a* and 15*b* corresponding to individual customers to be inserted into envelopes at an inserting station (not shown). In this respect, a controlling mechanism 17 drives conveying feed rolls 19 to convey the checks along the feed surface 14 until all of an individual's checks have been loaded in front of a pair of insert-conveyor pins 21, at which time the controlling mechanism 17 stops the conveying feed rolls 19 to allow the insert-conveyor 13 to index one time so that a new set of insert-conveyor pins 21 move into position for receiving checks.

There is a separator card positioned between the checks of the various individual customers. These separator cards are sensed by a sensor 23, and the controlling mechanism 17 stops feeding checks in response thereto as is described above. Thus, a separator card is stopped at a position immediately ready to be fed from the feed surface 14 onto the insert-conveyor 13.

Describing next a diverting mechanism for diverting the separator cards away from the insert-conveyor 13, this mechanism comprises a rotatable surface member 27 fixedly mounted on a shaft 29. The shaft 29 is attached to a gear 31 through a ratchet linkage mechanism 33.

The gear 31 meshes with a rack 34 which is reciprocally driven by a cam 35. In this respect, when a large lobe 37 of the cam 35 urges a pin 39 attached to the rack 34 forwardly, the rotatable surface member 27 is rotated 180° via the gear 31 and the ratchet linkage mechanism 33. When the cam 35 is rotated further such that its smaller lobe 41 allows a spring 43 to pull the rack 34 rearwardly, the gear 31 is rotated in an opposite direction, however, this motion is not transmitted through the ratchet linkage mechanism 33 to rotate the rotatable surface member 27. Thus, during each rotation of the cam 35 the rotatable surface member 27 rotates in only one direction for an angular distance of 180°.

A sensor 45 (shown in greater detail in FIG. 5) senses when the rotatable surface member 27 is in a proper stationery position, and, to some extent, helps the rotatable surface member 27 achieve the proper position. The sensor 45 comprises a notched roller 47 which is attached to the rotatable surface member 27 via the shaft 29, a sensor roller 51, and an electrical sensing element 53. The notched roller 47 has notches 55*a* and *b* therein into which the sensor roller 51 fits. In this regard, when the rotatable surface member 27 is in a proper stationery position, a spring 57 holds the sensor roller 51 in a notch 55*a* or *b*. In this position, a portion 59 of a mount for the sensor roller 51 contacts an electrical contact 61 thereby indicating to the electrical sensing element 53 that the rotatable surface member 27 is in a proper position. However, when the rotatable surface member 27 is not in a proper position, the sensor roller 51 will not be in a notch 55*a* or *b* and it will, therefore, be positioned such that portion 59 of its mount contacts an electrical contact 65. This indicates to the sensing element 53 that the rotatable surface member 27 is not in a proper stationery position.

If the rotatable surface member 27 is not turned quite far enough, the sensor roller 51 will interact with the appropriate notch 55*a* or *b* under the force of the spring 57 to move the rotatable surface member 27 to a proper stationery position. However, if the rotatable surface member 27 is rotated too far, it will not be possible for the sensor roller 51 to rotate the rotatable surface member 27 back to a proper position because the ratchet linkage mechanism 33 will not allow such movement. When this occurs, the portion 59 of the sensor roller mount remains in contact with the electrical contact 65 and the sensing element 53 sounds an alarm and/or shuts down the machine.

Turning next to apparatus for receiving diverted separator cards, this apparatus comprises a second surface member 67 positioned adjacent to, but above, the insert-conveyor 13. The second surface member 67 is positioned on the opposite side of the insert-conveyor 13 from the feed surface 14 and the conveying rolls 19. In this respect, the rotatable surface member 27 is positioned between the feed surface 14 and the second surface 67, and it is above the plane of the feed surface 14. Flexible guides 71 are mounted above the second surface member 67 for directing sheets passing over the rotatable surface member 27 on a downwardly angled path toward feed rolls 73*a* and *b*. The feed rolls 73*a* and *b* drive sheets into a receptacle 75.

Figure 2:
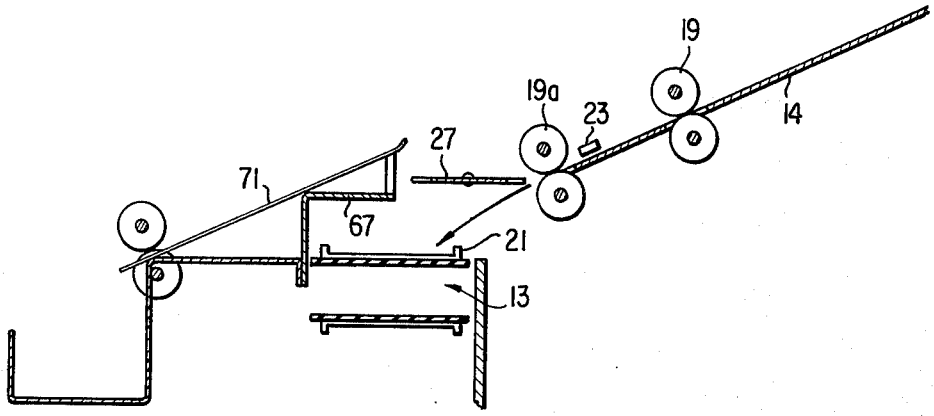
FIGS. 2–4 are fragmental views taken on line 2,3,4—2,3,4 of FIG. 1 depicting a portion of the sheet diverter at different time intervals in an operation cycle; and, FIG. 5 is a sectional view of a portion of the sheet diverter of FIG. 1 with a control element therefor being depicted in block diagram form.
Figure 3:
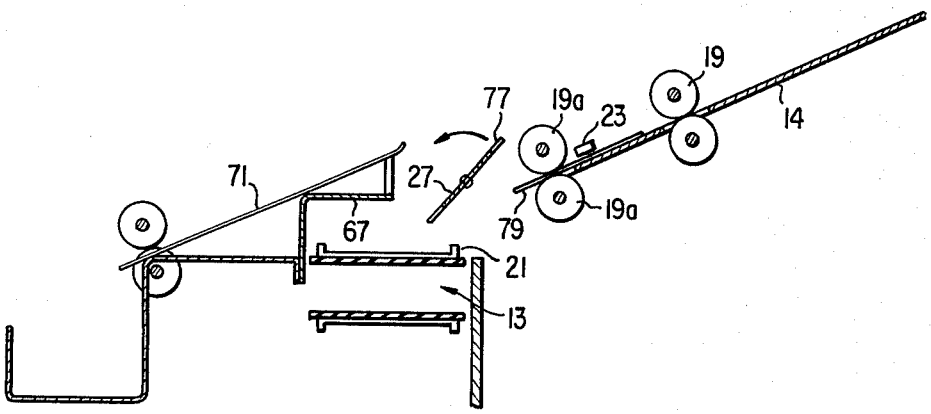
Figure 4:
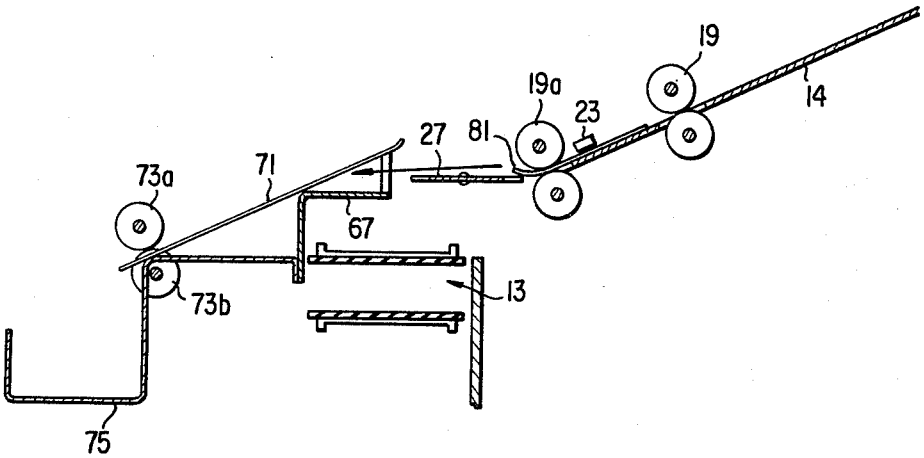
Figure 5:
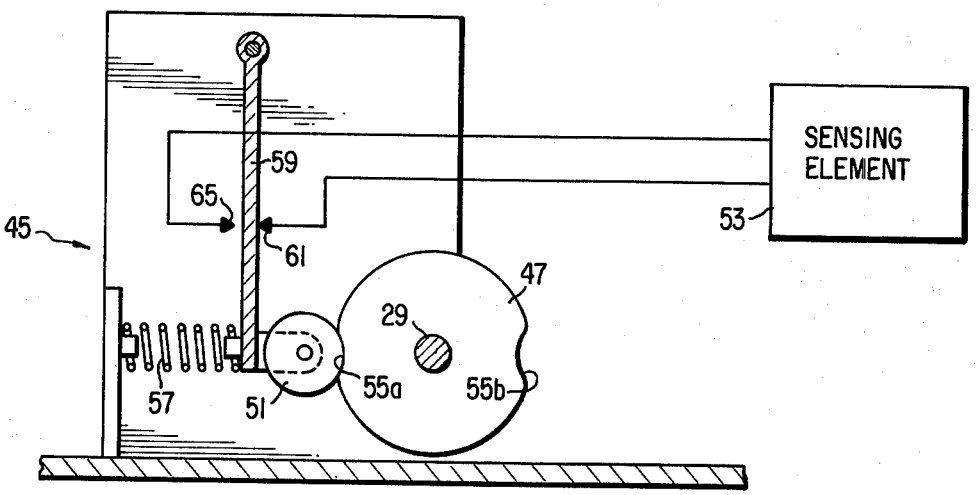

In operation, with particular reference to FIGS. 2–4, checks and separator cards are fed along the feed surface 14 by the conveying feed rolls 19. The checks for a particular individual are fed in this manner under the rotatable surface member 27 off the end of the feed surface 14 in front of a pair of insert-conveyor pins 21 on the insert conveyor 13. When the sensor 23 senses that a separator card is about to be fed off the feed surface 14, the controlling mechanism 17 (FIG. 1) responds thereto by deactivating the conveying feed rolls 19, thereby stopping the sensed separator card with the leading edge thereof protruding slightly from the feed surface 14 as shown at 79 in FIG. 3. The insert-conveyor 13 is then indexed one increment so that a new set of insert-conveyor pins 21 is moved to receive the next individual customer's checks. Also during this period, the controlling mechanism 17 rotates the cam 35 through 360° which drives the rack 34 outwardly and back. This, in turn, rotates the rotatable surface member 27 through 180° in a counterclockwise direction (see FIG. 3). During this rotation, the forwardly-most conveying feed rolls 19*a* are not contacted by the rotatable surface member 27 because of notches 77 in the rotatable surface member 27.

When the rotatable surface member 27 is thusly rotated 180°, it is rotated through the path of the separator card indicated at 79 in FIG. 3 in front of its leading edge and then back through the path under the separator card itself. This, lifts the leading edge of the separator card onto the top of the rotatable surface member 27 as indicated at 81 in FIG. 4.

After a sufficient time has elapsed for these steps to take place, the controlling mechanism 17 again activates the conveying feed rolls 19. The separator card, which is now on top of the rotatable surface member 27, is fed over the rotatable surface member 27 onto the second surface member 67. From here, the separator card is fed into the receptacle 75 by the feed rolls 73. Subsequent checks are again fed under the rotatable surface member 27 onto the insert conveyor 13.

When another separator card is sensed by the sensor 23 this cycle is repeated.

If the rotatable surface member 27 is in an improper position at a particular time during its cycle of operation, the sensor roller 51 will sense this by cooperating with the notches 55*a* and *b* in the notched roller 47 as is described above.

It should be noted by those skilled in the art that the sheet diverter mechanism described herein is extremely fast in operation. Further, it should be noted that a selected sheet can be diverted by activating this mechanism once, and that the mechanism must not thereafter be deactivated, or returned to an original state, to prevent subsequent sheets from being diverted.

While the invention has been particularly shown and described with reference to a preferred embodiment, it will be understood that various changes in form and detail may be made therein without departing from the spirit and scope of the invention. For example, although the separator cards are stopped prior to activation of the rotatable surface member 27, this is not necessary and the rotatable surface member 27 could be rotated to separate cards even if they were not stopped. In this regard, it would be possible to separate a number of consecutive cards or sheets by continuously rotating the rotatable surface member 27.

The embodiments of the invention in which an exclusive property or privilege are claimed are defined as follows:

1. A document diverter for diverting documents from a first path to a second path, said diverter comprising a rotatable surface means having an axis of rotation adjacent to, but offset from said first path, said rotatable surface means having a stationery position outside of said first path for allowing documents travelling on said first path to pass said rotatable surface means without being diverted to said second path, and an actuating means for selectively rotating in a single direction said rotatable surface means about said axis through said first path downstream of a document's leading edge to the other side of the document and then back through said first path at said document, carrying said document with it, to thereby move said document to said second path.

2. A document diverter as in claim 1 wherein said actuating means includes a means for stopping a document to be diverted before said rotatable surface means is rotated.

3. A document diverter as claimed in claim 1 wherein said rotatable surface means is an elongated flat surface which is geometric about a single axis, and its axis is transverse to, but parallel with said first path.

4. A document diverter as claimed in claim 3 wherein said actuating means includes a means for stopping a document to be diverted before said rotatable surface means is rotated.

5. A document diverter as claimed in claim 1 wherein is further included a sensing means for sensing when said rotatable surface means is in a proper stationary position, said sensing means comprising a first roller attached to said rotatable surface means, said first roller having a notch in the outer periphery thereof and a second roller biased toward said first roller and fitting into said notch when said rotatable surface means is in a proper stationary position.

6. A document diverter comprising:

a first conveyor for conveying documents along a first surface toward an end of said first surface;

a second conveyor positioned adjacent to the end of said first surface;

a third conveyor also positioned adjacent to the end of said first surface;

a diverter comprising a rotatable surface means having an axis of rotation located beyond the end of said first surface and above the plane of said first surface, said rotatable surface means having a stationary position out of the plane of said first surface whereby documents are allowed to pass from said first surface to said second conveyor but said rotatable surface means having a portion thereof extending into said plane of said first surface when said rotatable surface means is rotated to contact and lift documents;

a control means for controlling said first conveyor and said diverter, said control means stopping said first conveyor with the leading edge of a document to be diverted extending beyond the end of said first surface and thereafter rotating said rotatablw surface means in a single direction, thereby lifting the leading edge of said document from a position under said rotatable surface means to a position over said rotatable surface means, said control means thereafter driving said first conveyor to drive said document to be diverted over said rotatable surface means to said third conveyor.

7. A document diverter as claimed in claim 6 wherein is further included a sensing means for sensing when said rotatable surface means is in a proper stationary position, said sensing means comprising a first roller attached to said rotatable surface means, said first roller having a notch in the outer periphery thereof and a second roller baised toward said first roller and fitting into said notch when said rotatable surface means is in a proper stationary position.

8. A document diverter as claimed in claim 6 wherein said rotatable surface means is an elongated flat member which is geometric about a single axis, and its axis is transverse to, but parallel with said first surface.

9. A method of diverting documents conveyed along a first path to a second path by means of a rotatable surface member having an axis of rotation located above, but transverse to, and parallel with, the first path, said method comprising the steps of:

sensing when the leading edge of a document to be diverted is approximately under said rotatable surface member;

rotating said rotatable surface member so that a portion thereof extends through said first path in front of the leading edge of said document to be diverted and back through said path under said document to be diverted, thereby lifting the document to be diverted;

further conveying the document to be diverted over said rotatable surface member to said second path.

* * * * *